US005770005A

United States Patent [19]

Staniszewski

[11] Patent Number: 5,770,005

[45] Date of Patent: Jun. 23, 1998

[54] ENVELOPE FLAP SEALING DEVICE

[75] Inventor: Tadeusz Staniszewski, Budd Lake, N.J.

[73] Assignee: Shap, Inc., Budd Lake, N.J.

[21] Appl. No.: 746,481

[22] Filed: Nov. 12, 1996

[51] Int. Cl.[6] ..... B43M 5/00; B43M 5/04

[52] U.S. Cl. ..... 156/442.1; 156/441.5; 156/442.2; 156/578

[58] Field of Search ..... 156/441.5, 442.2, 156/442.1, 443, 578

[56] References Cited

U.S. PATENT DOCUMENTS

| | | | |
|---|---|---|---|
| 1,090,771 | 3/1914 | White | 156/442.2 |
| 1,176,072 | 3/1916 | McDade | 156/442.2 |
| 1,799,820 | 4/1931 | Keiser | 156/442.2 |
| 4,428,794 | 1/1984 | Hayskar et al. | 156/442.2 X |
| 4,834,699 | 5/1989 | Martin | 493/421 |
| 4,950,349 | 8/1990 | Ferreol-Ragotin | 156/442.2 X |
| 5,133,828 | 7/1992 | Jacques | 156/441.5 X |
| 5,192,389 | 3/1993 | Martin | 156/442.1 X |
| 5,217,551 | 6/1993 | Nobile et al. | 156/442.2 X |
| 5,489,358 | 2/1996 | Miciukiewicz | 156/441.5 X |

*Primary Examiner*—Jeff H. Aftergut
*Attorney, Agent, or Firm*—Bernard J. Murphy

[57] ABSTRACT

A housing confines therewithin a saturated sponge, the same disposed for moistening the flap of an envelope. Too, the housing has a entry slot for an envelope, and a switch, with an operating sensor or limb which detects the entry of an envelope into the housing, for the purpose of rotating rollers which (a) move the envelope from the entry slot to an exit, and (b) cause the flap to wipe across the sponge and seal against the body of the envelope.

7 Claims, 3 Drawing Sheets

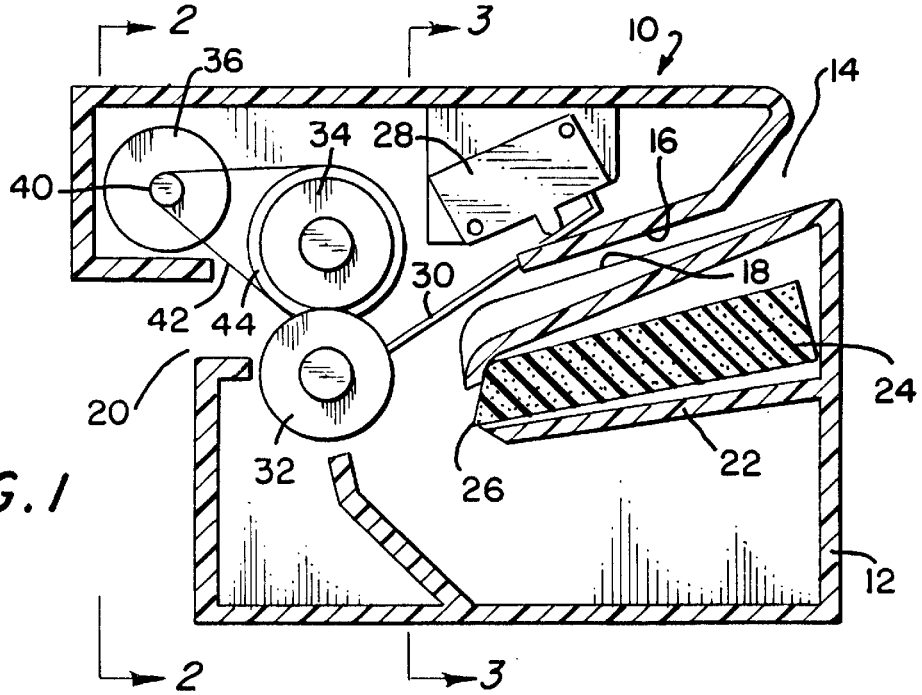
FIG. 1
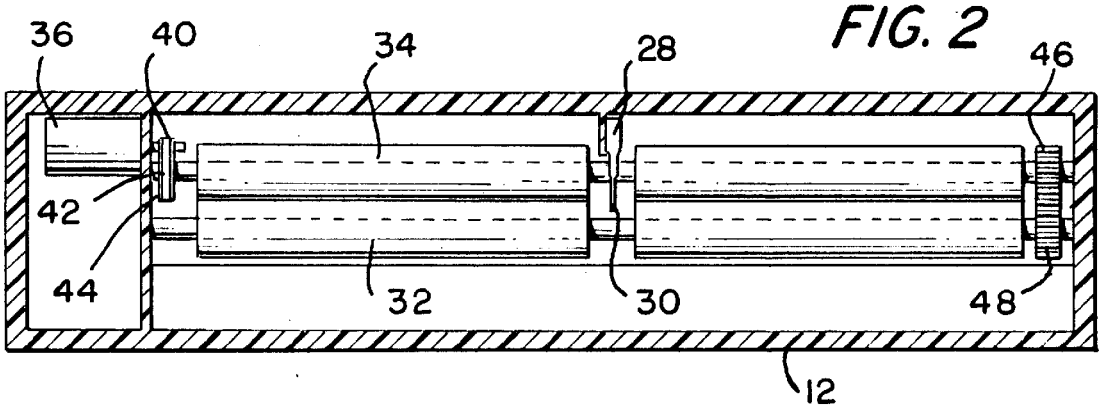
FIG. 2
FIG. 3
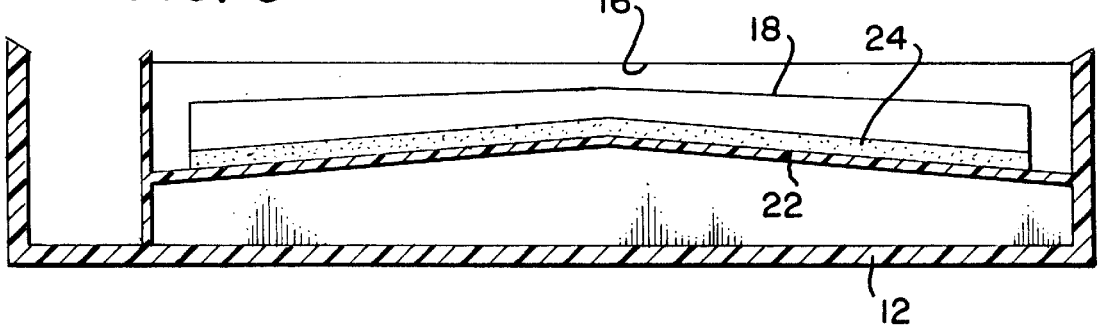

FIG. 4
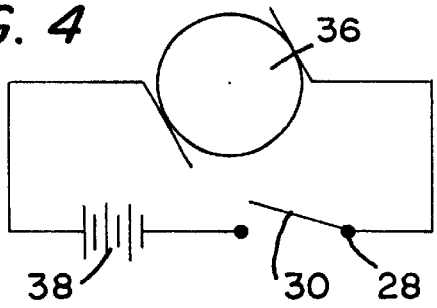
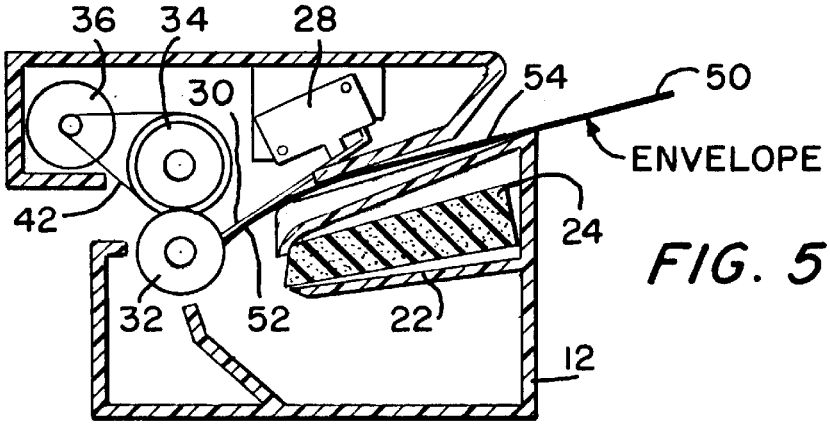
FIG. 5
FIG. 6
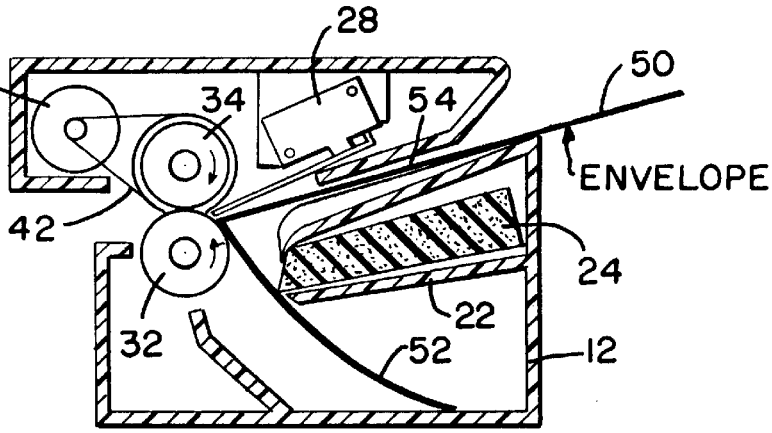
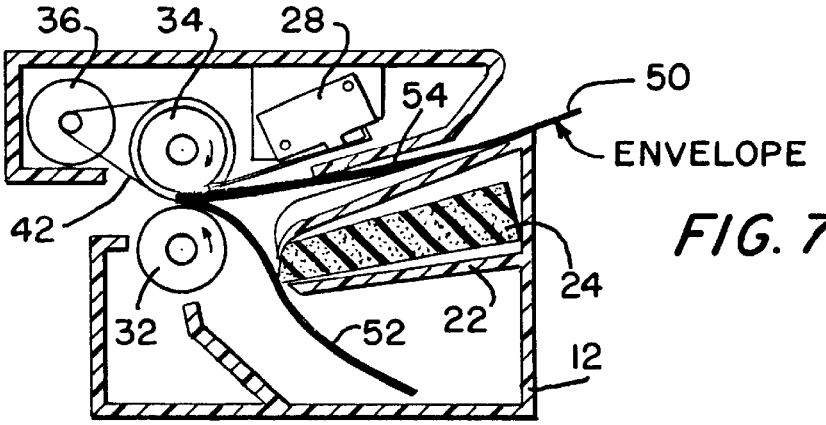
FIG. 7

ENVELOPE FLAP SEALING DEVICE

Envelope flap sealing devices, which accept the gummed flap of an envelope, moisten the same, and press the flap onto the body of the envelope to effect a sealing thereof, are rather complex and, accordingly, expensive to fabricate and maintain. Consequently, in view of the long felt need for an uncomplicated, envelope flap sealing device, having a minimal of moving parts, and of simple efficiency, the Envelope-Flap Sealing Device, disclosed in U.S. Pat. No. 5,466,327, of Nov. 14, 1995, issued to Tadeusz Staniszewski, was conceived.

The Device, in the aforesaid patent, is remarkably simple of structure, and has a base number of parts. It is quite efficient and, as disclosed, comprises a manually operative device.

It is an object of this invention to set forth a powered version of an envelope flap sealing device which incorporates some of the teachings of U.S. Pat. No. 5,466,327, and offers alternative embodiments.

Particularly, it is an object of this invention to disclose an envelope flap sealing device, comprising a housing; wherein said housing has first means, formed in said housing, for admitting an envelope which has a flap and a body into said housing; said housing has second means, formed in said housing, for discharging such a housing-admitted envelope from said housing; said housing further has third means, confined within said housing, for moistening the flap of such a housing-admitted envelope; and said housing also has a fourth means, mounted within said housing, and operative in response to an admittance of an envelope into said housing, for (a) forceably moving a flap-moistened envelope through said housing, from said first means to said second means, and (b) sealing said flap against said body.

Further objects of this invention, as well as the novel features thereof, will become apparent by reference to the following description, taken in conjunction with the accompanying figures, in which:

FIG. 1 is a side elevational view, partly in cross-section, of an embodiment of the invention;

FIG. 2 is a view, taken along section 2—2 of FIG. 1, in which a portion of the housing outer wall is omitted;

FIG. 3 is a depiction, taken along section 3—3 of FIG. 1, showing only the lowermost portion of the housing;

FIG. 4 is a simple schematic diagram showing the power source, motor, and switch electrically interconnected;

FIG. 5 is a view, in reduced scale, quite like that of FIG. 1, showing the flap of an envelope entered into the housing, and abutting the lowermost roller;

FIG. 6 is the same as FIG. 6, except that herein the flap is fully entered into the lower portion of the housing, and the body of the envelope has displaced the switch-operating sensor, and is closing onto the nipping rollers;

FIG. 7 is the same as FIGS. 5 and 6 in which the gummed flap of the envelope is wiped across the sponge, for moistening, and the body of the envelope moves into the nip of the rollers;

FIG. 9 is an illustration of an alternative embodiment of the invention which corresponds generally to the embodiment shown in FIG. 1, except that herein one of the rollers is dispensed with.

Figure 8:
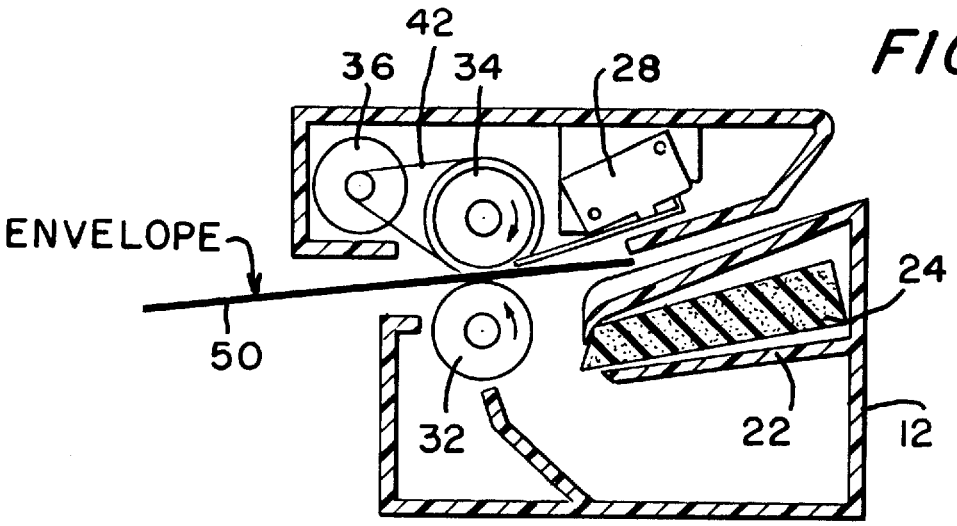
FIG. 8 is the same as FIGS. 5–7 in which, now, the envelope, with the flap sealing against the body thereof, is exiting the rollers.

With particular reference to FIGS. 1 through 4 the novel envelope flap sealing device 10 comprises a housing 12 having a slot 14 formed therein, and opening into the housing 12, for admitting an envelope into the housing. The slot 14 is formed of spaced-apart, confronting surfaces 16 and 18; surface 18 comprises a housing-entry slide for housing-admitted envelopes. Too, the housing 12 has an opening 20, formed in the housing 12 on a side thereof which is opposite the slot 14. An inwardly-directed ledge 22, which is slightly angled downwardly, supports thereon a sponge 24 below the slot 14. The configuration of the sponge 24 is such that an end 26 thereof projects beyond the ledge 22 and surface 18 into the housing 12.

Mounted within an upper portion of the housing 12 is a switch 28 which has a switch-operating sensor 30. The sensor 30, an elongate limb, is set across an inner termination of the slot 14, the same so disposed for detecting whatever enters the housing 12 via the slot 14. The innermost end of the sensor 30 is normally in the attitude shown in FIG. 1, in close proximity to a lower one 32 of two rollers 32 and 34. The rollers are journalled in the housing 12, in parallel and in contacting, nipping engagement therebetween. The same comprise means, cooperative with the switch 29 and its sensor 30, for moving an envelope, following the moistening of its flap, through the housing 12 from the slot 14 to the opening 20 for exit thereof from the housing, while sealing the moistened flap against the body of the envelope.

A motor 36, which is supplied electrical power from a source 38, is supported within an upper portion of the housing 12. The motor 36 has a small sheave 40 which, by means of a belting 42, imparts rotary drive to roller 34, via a large sheave 44 which is secured to roller 34. At the side of the housing 12, opposite whereat the motor 36 is supported, the rollers 32 and 34 have mutually-engaging spur gears. Consequently, rotation of roller 34 is imparted to roller 32 by the gears 46 and 48. The rollers 32 and 34 are covered with elastomeric material, so that, upon an envelope with contents therein moving between the rollers 32 and 34, the material yields to accommodate the thickness of the envelope.

Reverting to the sponge 24 and ledge 22, again. Means, not shown, at an end of the housing 12, comprises a portal through which the sponge 24 can be extracted for immersion in water and returned to the ledge 22. The ledge 22 is angled downwardly, as prior noted, to keep the end 26 of the sponge 24 well moistened.

In use, an envelope 50 is inserted into the slot 14, as shown in FIG. 5, with the gummed flap 52 facing downwardly, upon the slide surface 18. Sensor 30 has sufficient rigidity to resist movement by the flap 52 and, as sensor 30 traverses the plane of the housing-entry slide surface 18, inboard of the slot 14, it unyieldingly directs the flap 52 downwardly toward the sponge 24. The flap 52, for being relatively limp and hinged to the body 54 of the envelope, is forced downwardly, as afore-said, by the sensor 30, and also by the roller 32 which, at this time, is at halt, and simply presents itself as a static, convex wall to the flap 52. With further entry of the envelope 50 into the housing 12, as shown in FIG. 6, the flap 52 is fully disposed in the area below and adjacent to the sponge 24. Meanwhile, the body 54 of the envelope 50, stiffened with its document or correspondence insert, engages and deflects the sensor 30. As a consequence, the rollers 32 and 34 rotate and proceed to move the envelope 50 therebetween. While this occurs, the flap 52 is wiped across the end 26 of the sponge 24 for moistening. The latter is depicted in FIG. 7 where it can be seen that the spine or hinge of the envelope 50, where the flap 52 and the body 54 of the envelope join, is within the nip between rollers 32 and 34. The flap 52 of the envelope

50 is drawn up against the body 54 of the envelope and, in passing through the rollers 32 and 34, is sealed against the envelope body 54. Then, the sealed envelope 50 is discharged from the housing 12, as shown in FIG. 8, with the flap 52 adhered to the body 54. With the discharge of the sealed envelope 50, the sensor 30 returns to its position, its normal disposition, as shown in FIG. 1, and the switch 28 opens again to bring the rollers 32 and 34 to a halt.

Figure 9:
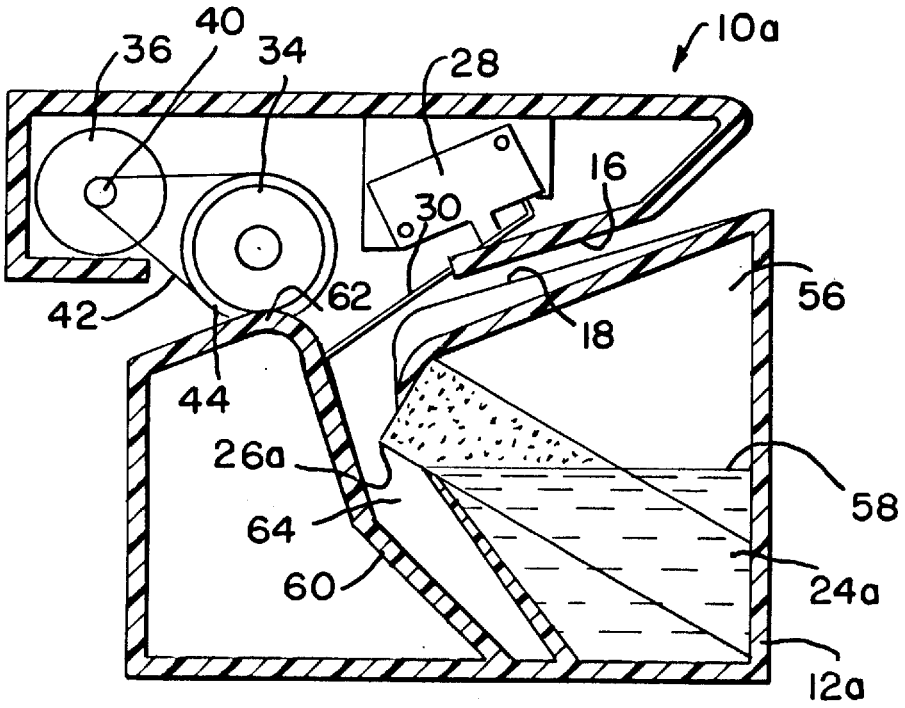

An alternative embodiment 10*a* of the novel envelope flap sealing device is shown in FIG. 9, the latter corresponding, generally, to FIG. 1 of the first embodiment 10. Parts and components shown in FIG. 9 which have same or similar index numbers as set out in FIG. 1 represent same or similar parts and components as in the first embodiment.

The device 10*a*, quite as shown in prior U.S. Pat. No. 5,466,327, has a reservoir 56 formed therewithin in which to retain the moistening agent, the sponge 24*a*, in a supply of water 58. Here too, as in the just-cited patent, which is incorporated by reference, for a more extensive disclosure of the sponge -holding arrangement, an outwardly extending edge 26*a* of the sponge 24*a* is disposed for engaging the flap 52 of an envelope 50 as the flap rises from the lower portion of the housing 12*a*.

In device 10*a*, one of the rollers, namely roller 32, is dispensed with. In lieu of a roller cooperating with roller 34, the housing 12*a* is formed with a wall 60 having an arcuate rim 62. In this embodiment of the invention, the flap 52 of the envelope 50 moves below the sensor 30, and engages the wall 60. Consequently, it is turned downwardly, into a channel 64, into which the edge 26*a* intrudes. Upon the stiffened body 54 of the envelope reaching the sensor 30, the latter is displaced, the switch 28 closes, and the motor 36 drives roller 34 in rotation. Now, the spine or hinge portion of the envelope 50 enters the nip between the rim 62 and the roller 34, and it is drawn therethrough. Again, the flap 52 wipes across the edge 26*a*, and follows the body 54 of the envelope 50 through the nip for sealing against the body 54.

While I have described my invention in connection with specific embodiments thereof, it is to be clearly understood that this is done only by way of example, and not as a limitation to the scope of the invention, as set forth in the objects thereof, and in the appended claims. As noted, the rollers 32 and 34 have elastomeric covering. In addition, the rollers can be ribbed, longitudinally, to enhance the nip therebetween. The belting 42 can be of a rubber and nylon, or such, band, or any other durable composition, and the sponges 24 and 24*a* can be of natural state or synthetic. These alternatives, which will occur to others, by taking teaching from my disclosure, are deemed to be within the ambit of the invention, and embraced by the appended claims.

I claim:

1. An envelope flap sealing device, comprising:

a housing; wherein said housing has first means, formed in said housing, for admitting an envelope which has a flap and a body into said housing;

said housing has second means, formed in said housing, for discharging such a housing-admitted envelope from said housing;

said housing further has third means, confined within said housing, for moistening the flap of such a housing-admitted envelope; and said housing also has fourth means, mounted within said housing, and operative in response to an admittance of an envelope into said housing, for (a) forceably moving a flap-moistened envelope through said housing, from said first means to said second means, and (b) sealing said flap against said body; wherein said first means comprises a slot opening into said housing;

said slot is formed of-spaced-apart, confronting surfaces;

one of said surfaces comprises a housing-entry slide, having a given plane, for an envelope;

said fourth means comprises an electrical switch;

said switch has a switch-operating sensor;

said sensor is set across an inner termination of said slot and traverses said plane; and said sensor comprises means for (a) unyieldingly directing an envelope flap toward said third means, and (b) yieldingly displacing, upon engagement thereof by the body of an envelop, to permit travel of an envelope to said second means.

2. An envelope flap sealing device, according to claim 1, wherein:

said third means comprises an absorbent element disposed beneath said admitting means.

3. An envelope flap sealing device, according to claim 3, wherein:

said fourth means further comprises a powered roller interposed between said slot and said second means.

4. An envelope flap sealing device, according to claim 1, wherein:

said fourth means further comprises a motor mounted within said housing, a roller journalled in said housing, power-transmission belting drivingly coupled to said roller from said motor, and means electrically interconnecting said switch and said motor.

5. An envelope flap sealing device, according to claim 4, wherein:

said fourth means further comprises an arcuate surface, formed within said housing, paralleling said roller; and said arcuate surface and said roller cooperatively define a nip therebetween.

6. An envelope flap sealing device, according to claim 1, wherein:

said fourth means further comprises a motor mounted within said housing, a pair of rollers journalled in said housing, power-transmission belting drivingly coupled to one of said rollers from said motor, means borne by said rollers for causing rotation of said one of said rollers to impart rotation to the other of said rollers, and means electrically inter-connecting said switch and said motor.

7. An envelope flap sealing device, according to claim 6, wherein:

said rollers are parallel with each other, and cooperatively define a nip therebetween.

* * * * *